US006851160B2

(12) United States Patent
Carver

(10) Patent No.: US 6,851,160 B2
(45) Date of Patent: Feb. 8, 2005

(54) QUICK RELEASE DETACHABLE BUCKLE

(75) Inventor: John W. Carver, Dittmer, MO (US)

(73) Assignee: Eagle Industries Unlimited, Inc., Fenton, MO (US)

( * ) Notice: Subject to any disclaimer, the term of this patent is extended or adjusted under 35 U.S.C. 154(b) by 0 days.

(21) Appl. No.: 10/248,617

(22) Filed: Jan. 31, 2003

(65) Prior Publication Data

US 2003/0145435 A1 Aug. 7, 2003

Related U.S. Application Data

(60) Provisional application No. 60/353,238, filed on Feb. 1, 2002.

(51) Int. Cl.[7] ..... A44B 11/04
(52) U.S. Cl. ..... 24/197; 24/200
(58) Field of Search ..... 24/198, 200, 197, 24/163 R, 115 F, 265 BC

(56) References Cited

U.S. PATENT DOCUMENTS 330,900 A * 11/1885 Johnson et al. ..... 54/55
1,826,174 A * 10/1931 Hodge ..... 24/163 R
2,429,926 A * 10/1947 Davis ..... 24/197
4,365,391 A * 12/1982 Chapalain ..... 24/197
4,525,007 A * 6/1985 Chapalain ..... 294/74
4,677,711 A * 7/1987 Anscher ..... 24/200
5,016,325 A * 5/1991 Rasmussen ..... 24/68 R
5,058,243 A * 10/1991 Rasmussen ..... 24/68 R
5,205,021 A * 4/1993 Durand ..... 24/163 R
5,426,829 A * 6/1995 Hsiung ..... 24/197
5,651,166 A * 7/1997 Lundstedt ..... 24/200
5,836,631 A * 11/1998 Coe ..... 294/74
5,933,923 A * 8/1999 Catlos et al. ..... 24/68 CD
6,076,237 A * 6/2000 Goorhouse ..... 24/200

FOREIGN PATENT DOCUMENTS

FR 2459764 A * 2/1981 ..... B65D/63/16

* cited by examiner

*Primary Examiner*—James R. Brittain
(74) *Attorney, Agent, or Firm*—Blackwell Sanders Peper Martin LLP

(57) ABSTRACT

The present invention relates to a detachable style buckle which is detachable from a strap end portion. The detachable end of the strap is attached to a member which is detachable mounted to a buckle body and that can be quickly and reliably detached from the buckle body. The buckle is constructed to releasably retain another strap end portion therein.

17 Claims, 2 Drawing Sheets

QUICK RELEASE DETACHABLE BUCKLE

CROSS REFERENCE TO RELATED APPLICATION

This Non-Provisional Application is based on Provisional Application Ser. No. 60/353,238, Filed Feb. 1, 2002 for A QUICK RELEASE DETACHABLE BUCKLE.

BACKGROUND OF INVENTION

Straps are commonly used to secure one item to another item, apply loads to items, for example, cinch straps, or for carrying items, for example, the strap on a backpack, briefcase, camera bag or the like. Several forms of devices have been constructed to provide for adjustment of the straps in length and to allow a strap to be separated at ends in a selective manner, to facilitate mounting of an item on an object or person.

One form of such device is called a ladder type lock buckle which has a strap secured to one end of the buckle. The strap is generally attached in a permanent manner, or through the use of additional fastening devices, can be removably attached to one end of a strap. The ladder type buckle is constructed to receive another strap end therein. Typically, the strap is adjustable in the buckle and the buckle is designed to be self locking on the strap to fix the strap at a predetermined length and/or tension. To loosen the strap, one lifts a tab adjacent to the securement member which allows locking teeth to become disengaged from the strap and the person simply moves the strap within the buckle. Such release is difficult through when the user was wearing gloves. Oftentimes, a stop is provided on the strap to prevent the strap from becoming disengaged completely from the buckle. If a stop is used to prevent the free end of the strap from separating from the buckle and a loop is used to attach the other end of the strap to the buckle then the strap could not be readily released by a wearer of the item. Separating one object from another object connected together with such a buckle and strap arrangement is also difficult.

Another form of such buckle is the military style belt buckle that is semi-permanently secured to a normally fixed end of a belt (strap) by an over center toothed locking member. The locking member has a small lever portion with a free end engaging the belt webbing when locked in place while allowing separation of the fixed end of the belt from the buckle. This is cumbersome and very difficult to do in an emergency situation or if the user is wearing gloves or the like. The free end of the belt is inserted through the buckle and engaged by a camming toothed roller locking the belt in place with tension in the belt. To release such a buckle, the user pulls the free end of the belt with one hand, releases the locking roller with the other hand and by holding the locking roller in a position of disengagement with the belt webbing, the free end of the belt can be released from the buckle.

Another type of buckle is a side release buckle. The two halves of the buckle are each attached to a respective strap end. Separation of the buckle halves requires moving two release buttons toward one another with one hand and pulling the buckle halves apart with the other. This is also inconvenient under extreme or emergency conditions.

While effective, in their typical uses, such buckles do not provide for a quick release when the strap ends need to be readily separated particularly with limited motion of a users hand while still providing the convenience of an easy to use buckle allowing easy and sure adjustment of the length of the strap or strap portions.

SUMMARY OF INVENTION

The present invention involves the provision of a strap arrangement utilizing a quick release buckle that has means to allow for detachment of at least one end of a strap normally connected to the buckle from the buckle body facilitating quick and positive separation of the strap ends particularly in emergency situations. The buckle is particularly useful in military applications, rescue and in extreme sport applications. It may be utilized in combination with any product or in any environment where quick detachment is desirable and requires only one hand with simple movement to effect separation. The buckle includes means for retaining one strap end portion in a manner that allows for easy adjustment of strap length by a wearer or user. The buckle also includes a removable pin having a shank extending between the two side rails of the buckle body with the pin having means for releasably retaining the pin attached to the buckle body and adapted for extending through a loop or the like in one strap end. A pull cord may be attached to the pin to facilitate separation of the pin from the buckle body. The cord may also be used as a tether attached to the buckle body, strap or the like, to reduce the risk of losing the pin when separated from the buckle body.

These and other aspects and advantages of the present invention will become apparent upon reading the detailed description in connection with the drawings and the appended claims.

BRIEF DESCRIPTION OF DRAWINGS

Corresponding reference numerals designate like or similar parts throughout the various figures of the drawings.

DETAILED DESCRIPTION

Figure 1:
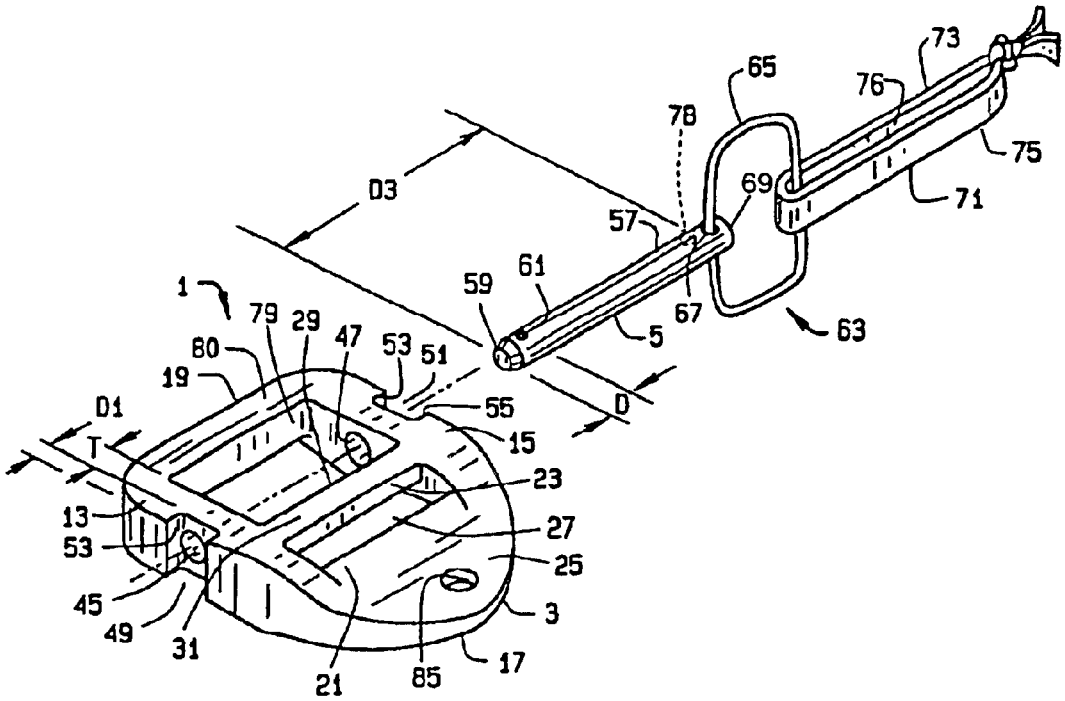
FIG. 1 is an exploded perspective view of quick release and detachable buckle.

The referenced numeral 1 designates generally a buckle comprising a buckle body 3 with a detachable pin 5. One end 6 of a strap portion 7 is attached to the pin 5 for selective release of retention thereby. A strap portion 9 is engageable with the buckle body 3. The strap portions 7, 9 may be part of a continuous strap or may be strap segments secured to an object 11 such as a backpack, fanny pack, pouch or the like.

Figure 3:
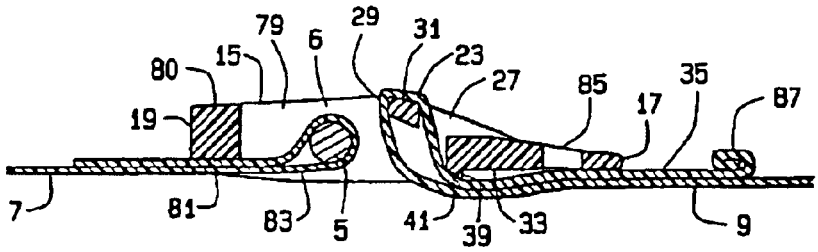
FIG. 3 is a sectional view of the buckle taken along the line 3—3 of FIG. 2 showing the buckle connected to a strap.
Figure 2:
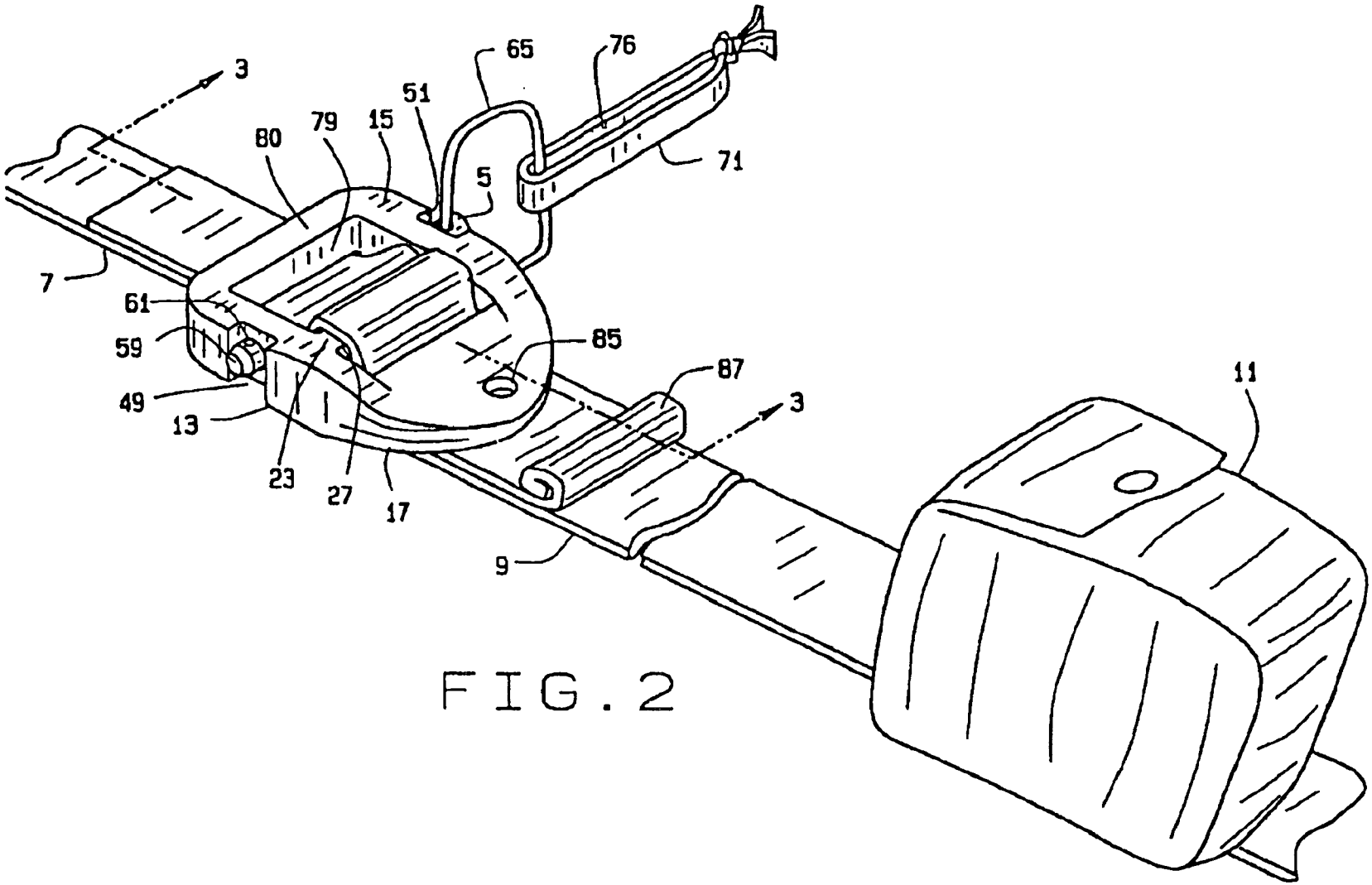
FIG. 2 is a perspective view of a buckle connected to a strap having an attached pack.

The buckle body 3 includes a pair of spaced apart and generally parallel side rails 13, 15 that extend between opposite ends 17, 19 of the buckle body. The buckle body 3 includes at least two members extending between the side rails and are shown as cross bars 21, 23. The cross bar 21 is adjacent the end 17 and includes a finger tab 25 that in use overlies the strap portion 9. The cross bar 23 extends between the side rails 13, 15 and is spaced from the bar 21 forming a slot 27 therebetween. The bar 23, as best seen in FIG. 3 is positioned at an elevation, when viewed in the side view, above the bar 21 to provide a serpentine path for the strap portion 9 to at least partially wrap around from the back side 29 over the top 31 and then under the bottom surface 33 of the bar 21. The free end 35 of strap portion 9 engages the bottom surface 33 of the cross bar 21. A member 39 is positioned on the bottom surface 33 and is engageable with the free end 35 to releasably retain tension in the strap portion 9. In the illustrated structure the member 39 comprises a plurality of teeth 41 extending in a row across the bar 21 each forming a forwardly facing hook, i.e., facing toward the end 17 that allows a user to pull the free end 35 in a direction from the end 19 toward the end 17. When the teeth 41 are in engagement with the free end 35, they resist movement of the free end 35 back through the buckle 1 to maintain tension as is well known in the art.

A pin 5, as best seen in FIG. 1, is detachable mounted to the buckle body 3 extending between the side rails 13, 15. In the illustrated structure the buckle body 3 includes a pair of axially aligned through bores 45, 47 that have their axes generally parallel with the longitudinal axis of the bar 23 and generally normal to the side rails 13, 15. Thus, when the pin 5 is installed on the buckle body 3, its longitudinal axis is also generally parallel to the longitudinal axis of the cross bar 23. In a preferred embodiment the through bores 45, 47 open into inwardly recessed and outwardly opening notches 49, 51 respectively which are recessed in outside surfaces of the respective side rail 13 or 15. The notches 49, 51 are defined by side surfaces 53 and bottom surfaces 55 with the bottom surfaces 55 defining a ledge or shoulder for a purpose later described.

The pin 5 includes a shank 57 (FIG. 1) that is preferably generally round in cross section and has a tapered end 59 for facilitating moving the shank 57 into and through the bores 45, 47. The shank 57 is generally sized and shaped similar to the bores 45, 47 and with a round cross section can rotate within the bores eliminating the need for rotationally orienting the pin 5 relative to the bores. The pin 5 is provided with a retainer 61 that will retain the pin 5 in attached relationship to the buckle body but permit its easy removal preferably with generally straight line movement via a pulling motion. In a preferred embodiment, the retainer 61 is resiliently biased to an outwardly projecting position. The retainer 61 includes a spring biased ball that moves inwardly when inserting the shank 57 through the bores 45, 47. When pin 5 is mounted on the buckle body 3, the retainer 61 will be engageable with one of the surfaces 55 to removably attach the pin 5 to the buckle body 3.

A grip, designated generally 63, is secured to the shank 57 to provide a user means to easily, pull the pin 5 and detach it from the buckle body 3 by moving the shank 57 longitudinally out through the bores 45, 47. In a preferred embodiment, the grip 63 includes a split ring 65 that extends through a through hole 67 adjacent an end 69 of the shank 57. A flexible cord 71 is secured to the ring 65. The cord 71 can be made out of woven fibers similar to shoe string material and can be tied at opposite ends 73, 75 thereof to form a loop 76. The cord 71 can be attached to for example, the buckle body 3, strap end 7 or other member, that will not impede pin detachment and will help prevent loss of the pin 5 when it is not attached in the buckle body 3.

When the pin 5 is retained in the buckle body 3, it is preferred that the distance D from the inside edge of the retainer 61 and the free end 59 be less than or approximately equal to the depth D1 of the notches 49, 51. This will help prevent inadvertantly detaching or at least partially detaching the pin 5 from the buckle body 3 by pushing on the end 59. Although the end 59 may extend outwardly of the outer sides of the side rails 13 or 15 so long as the projection does not exceed the thickness T of the side rail at the bores 45, 47 the risk of accidental detachment is reduced. Axial movement of the shank 57 through the bores 45, 47 is limited in one direction by engagement of the ring 65 with one of the surfaces 55. The use of the ring 65 as a stop would require rotational orientation of the pin 5 to ensure that the ring will go into a notch 49 or 51. To eliminate this rotational orientation issue, the shank 57 may alternatively be provided with a protuberance (shown in phantom in FIG. 1 as 78) projecting radially outwardly from the shank 57 to fit within one of the notches 49 or 51 for engagement with a surface 55. Such a protuberance could be a C-ring secured in a groove or a pin secured in a hole and projecting generally perpendicular to the longitudinal axis of the shank 57. Other forms of stops may be provided as are known in the art. Also, only one notch 49 or 51 could be provided but then the pin 5 could only be inserted from one side of the buckle body 3 to shield the end 59. The distance D3 from the stop to the free end is such as to accommodate the above described extension of the end 59 through the buckle body to a degree to help prevent accidental detachment of the member from the buckle body. The end 19 is formed by a cross bar 80. The bar 80 and the bar 23 form a second slot 79. Slot 79 provides an opening for a strap portion 7 to be fed around and over pin 5 and for the strap portion to exit the rear end of the buckle body. The surface 81 of the cross bar 80 is at an elevation below that of bars 23 to produce a torque or moment about the longitudinal axis of pin 5 to help teeth 41 engage the free end 35 of the strap portion 9.

The strap portion 7 includes a loop 83 through which the pin 5 extends to secure the buckle body 3 in a detachable manner. The loop 83 may be formed by overlapping the strap material and sewing, forming a permanent loop. However, it is to be understood that a slide buckle or other fastening device may also be used to form the loop 83.

While the foregoing describes a preferred embodiment of the present invention, alternatives of two described embodiments may be provided, for example, a through hole 85 may be provided in the bar 21. Such a hole 85 may be utilized for the attachment of a cord or strap to help facilitate release of tension in straps when held in tension by the buckle 1. Also, one of the bores 45 or 47 may be a blind bore having a bottom whereby it does not extend completely through a side rail. A circumferential and radially outwardly extending groove may be provided inside the blind bore to receive retainer 61 therein. The groove would form a shoulder functionally similar to the shoulder formed by the surface 55. Alternately, the bore could extend through a side rail to facilitate manufacture and still be provided with such a circumferentially and radially outwardly extending groove. A further alternate is to provide a catch 87 on the free end of strap end 9 to prevent separation of the buckle 1 from strap portion 9. The catch 87, as shown, is formed by folding the strap onto itself forming two or more layers of material and sewing the overlapped material.

Thus, there has been shown and described several embodiments of a novel quick release and detachable buckle. As is evident from the foregoing description, certain aspects of the present invention are not limited by the particular details of the examples illustrated herein and it is therefore contemplated that other modifications and applications, or equivalents thereof, will occur to those skilled in the art. Many changes, modifications, variations and other uses and applications of the present constructions will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A detachable buckle and strap arrangement said buckle and strap arrangement including:

at least one strap arrangement having a first strap end portion and a second strap end portion, the second strap end portion having a loop;

a buckle body including a pair of side rails positioned in spaced relationship and a first bar secured to and extending between said side rails;

a first cross member extending between the side rails and selectively engageable with a first strap end portion to releasably retain said first strap end portion against longitudinal movement within said buckle body;

a second cross member removably mounted on the buckle body and extending between the side rails, said second member being received through said loop to releasably fix the second strap end portion to the buckle body such that separation of the second member from the buckle body when the first and second strap end portions are connected to the buckle body releases the second strap end portion from attachment at the second strap end portion to the buckle body by the second cross member.

2. A detachable buckle and strap arrangement as set forth in claim 1 wherein the second member is adapted to be separated from the buckle body by longitudinal movement in one direction of the second member.

3. A detachable buckle and strap arrangement as set forth in claim 2 wherein the side rails have first and second bores therein in axial alignment and said second member extends through the first bore and at least partially into said second bore.

4. A detachable buckle and strap arrangement as set forth in claim 3 wherein said second member includes a shank having first and second opposite ends and a resiliently outwardly biased retainer adjacent the first end that can move inwardly to permit insertion of the shank through the first bore and into the second bore and cooperating with a shoulder to removably retain the second member attached to the buckle body.

5. A detachable buckle and strap arrangement as set forth in claim 4 wherein the second bore is through the respective side rail and an outside surface portion of the respective side rail at least partially defines the shoulder.

6. A detachable buckle and strap arrangement as set forth in claim 5 wherein the second member includes a grip secured to the shank adjacent the second end of the shank to facilitate separation of the second member from the buckle body.

7. A detachable buckle and strap arrangement as set forth in claim 6 wherein the shank has a through hole adjacent the second end and the grip includes a ring having a portion extending through the hole.

8. A detachable buckle and strap arrangement as set forth in claim 7 wherein the ring forms a stop operable to limit longitudinal movement of the shank in the first and second bores.

9. A detachable buckle and strap arrangement as set forth in claim 7 wherein the grip includes an elongate flexible cord operable to be gripped by a person to facilitate separating of the second member from the buckle body.

10. A detachable buckle and strap arrangement as set forth in claim 9 wherein the cord is operable to tether the shank to a device to help prevent loss of the second member when separated from the buckle body.

11. A detachable buckle and strap arrangement as set forth in claim 5 wherein at least one side rail includes an inwardly extending notch with a bottom surface portion with the respective through bore opening onto said bottom surface and said bottom surface forming said shoulder, said shank having a length such that its first end does not project beyond the outside surface portion of the side rail sufficiently to allow the shank to be accidentally pushed inwardly through said second bore.

12. A detachable buckle and strap arrangement as set forth in claim 11 wherein there is a said notch in each said side rail.

13. A detachable buckle and strap arrangement as set forth in claim 1 wherein the first strap end portion is engageable with the first member, said buckle body including a third member extending between said side rails and spaced from the first member defining a slot therebetween, said third member being operable for having said first strap end portion at least partially wrapped therearound and extending for engagement with the first cross member.

14. A detachable buckle and strap arrangement as set forth in claim 13 wherein said first cross member includes a plurality of teeth for.

15. A detachable buckle and strap arrangement as set forth in claim 1 wherein the strap arrangement is a single strap having the first and second strap end portions at opposite ends thereof engagement with the first strap end portion.

16. A detachable buckle for use with two flexible strap ends, said buckle including:

a buckle body including a pair of side rails positioned in spaced relationship and a first bar secured to and extending between said side rails, said side rails having first and second through bores in axial alignment, said second bore is through the respective side rail and an outside surface portion of the respective side rail at least partially defines a shoulder and wherein at least one said side rail includes an inwardly extending notch with a bottom surface portion with a respective said through bore opening onto said bottom surface, said bottom surface forming said shoulder;

a first cross member extending between the side rails and selectively engageable with a first strap end portion to releasably retain said first strap end portion against longitudinal movement within said buckle body;

a second cross member removably mounted on the buckle body and extending between the side rails, said second member being adapted to removably fix a second strap end portion to the buckle body such that separation of the second member from the buckle body releases the second strap end portion from attachment at the second strap end portion to the buckle body by the second cross member, said second member is adapted to be separated from the buckle body by longitudinal movement of the second member, said second member extends through the first and second through bores when mounted to the buckle body, said second member includes a shank having first and second opposite ends and a resiliently outwardly biased retainer adjacent to the first end that can move inwardly to permit insertion of the shank through the first and second through bores and cooperating with the shoulder to removably retain the second member attached to the buckled body, said shank has a length such that its first end does not project beyond the outside surface portion of the side rail sufficiently to allow the shank to be accidentally pushed inwardly through the second through bore.

17. A detachable buckle as set forth in claim 16 wherein there is a said notch in each said side rail.

* * * * *

UNITED STATES PATENT AND TRADEMARK OFFICE

CERTIFICATE OF CORRECTION

PATENT NO. : 6,851,160 B2
DATED : February 8, 2005
INVENTOR(S) : John Wayne Carver It is certified that error appears in the above-identified patent and that said Letters Patent is hereby corrected as shown below:

Title page,
Item [57], ABSTRACT, prior to the phrase "mounted to a buckle" delete "detachable" and replace with -- detachably --

Column 1,
Line 5, delete "This Non-Provisional Application is based on" and replace with -- This application claims the benefit of U.S. --

Column 3,
Line 4, delete "detachable" and replace with -- detachably --

Column 6,
Line 16, after the phrase "plurality of teeth for" insert -- engagement with the first strap end portion. --
Line 20, after the phrase "at opposite ends thereof" delete "engagement with the first strap end portion"

Signed and Sealed this

Seventeenth Day of May, 2005

JON W. DUDAS
*Director of the United States Patent and Trademark Office*